US009863728B2

(12) United States Patent
Pflaumer et al.

(10) Patent No.: US 9,863,728 B2
(45) Date of Patent: Jan. 9, 2018

(54) CYLINDER BREECH BLOCK DEVICE OF A REPEATING FIREARM

(71) Applicant: Carl Walther GmbH, Ulm (DE)

(72) Inventors: Wulf-Heinz Pflaumer, Arnsberg (DE); Franz Wonisch, Arnsberg (DE); Thomas Bretschneider, Neu-Ulm (DE); Sebastian Rosner, Traunstein (DE)

(73) Assignee: Carl Walther GmbH, Ulm (DE)

( * ) Notice: Subject to any disclaimer, the term of this patent is extended or adjusted under 35 U.S.C. 154(b) by 75 days.

(21) Appl. No.: 15/043,543

(22) Filed: Feb. 13, 2016

(65) Prior Publication Data

US 2016/0238334 A1 Aug. 18, 2016

(30) Foreign Application Priority Data

Feb. 13, 2015 (DE) ..... 10 2015 102 073

(51) Int. Cl.
*F41A 3/22* (2006.01)
*F41A 35/06* (2006.01)
*F41A 19/34* (2006.01)

(52) U.S. Cl.
CPC ..... *F41A 3/22* (2013.01); *F41A 19/34* (2013.01); *F41A 35/06* (2013.01)

(58) Field of Classification Search
CPC ..... F41A 3/14; F41A 3/16; F41A 3/20; F41A 3/26; F41A 3/28; F41A 3/30; F41A 3/36; F41A 3/64; F41A 3/66
USPC ..... 42/14, 16, 69.02
See application file for complete search history.

(56) References Cited

U.S. PATENT DOCUMENTS

| | | | | |
|---|---|---|---|---|
| 1,545,045 | A | 7/1925 | Dute | |
| 3,341,963 | A * | 9/1967 | Seiderman | F41A 3/20 42/16 |
| 3,791,060 | A * | 2/1974 | Weaver | F41A 3/72 42/16 |
| 6,508,025 | B1 * | 1/2003 | Du Plessis | F41A 15/12 42/16 |
| 8,302,340 | B1 | 11/2012 | Irwin | |
| 9,429,382 | B2 * | 8/2016 | Ives | F41A 3/22 |
| 2010/0175290 | A1 | 7/2010 | Duplessis et al. | |
| 2015/0198393 | A1 * | 7/2015 | Ives | F41A 3/22 42/69.02 |

(Continued)

FOREIGN PATENT DOCUMENTS

| | | | |
|---|---|---|---|
| DE | 9419743 | U1 | 4/1996 |
| DE | 10055578 | A1 | 5/2001 |
| GB | 2425163 | A | 10/2006 |

*Primary Examiner* — Jonathan C Weber
(74) *Attorney, Agent, or Firm* — Bachman & LaPointe, P.C.

(57) ABSTRACT

A cylinder breech block device (100) of a repeating firearm has a breech block cylinder (200) pivoted in a system housing (160) of the repeating firearm for execution of repetitive action thereof and capable of being locked to said system housing (160) for firing a round. A firing pin (140) capable of being cocked by a tension spring is mounted for linear displacement in the direction of a cartridge (141) stored in a magazine (141) of a barrel (143). Cocking of the firing pin (140) is effected by causing rotation, through a predefined angle, of a breech bolt handle (300) rigidly connected to a tension crown ring (400) that is pivoted on a central shaft (210) of the breech block cylinder (200).

24 Claims, 5 Drawing Sheets

(56) References Cited

U.S. PATENT DOCUMENTS

| | | | | |
|---|---|---|---|---|
| 2015/0233656 | A1* | 8/2015 | Karagias | F41C 23/04<br>42/16 |
| 2016/0252314 | A1* | 9/2016 | Mather | F41A 3/22<br>42/16 |

* cited by examiner

CYLINDER BREECH BLOCK DEVICE OF A REPEATING FIREARM

CROSS-REFERENCE TO RELATED APPLICATION

Priority is claimed to German Patent Application DE 10 2015 102 073.4, filed Feb. 13, 2015, the disclosure of which is incorporated by reference herein in its entirety as if set forth at length.

BACKGROUND

The invention relates to a cylinder breech block device of a repeating firearm having a barrel pivoted in a system housing of the repeating firearm for execution of repetitive action thereof and that is capable of being locked to the system housing for firing a round, in which a firing pin capable of being cocked by a tension spring is mounted for linear displacement in the direction of a cartridge stored in a magazine of a barrel.

Breech block devices of the aforementioned type are known in the prior art for example in the form of the Mauser 98 breech block system produced in large quantities and acknowledged as being robust and reliable.

The Mauser 98 breech block system has been provided with various refinements and improvements since its implementation in 1898, while the general principle of action has remained unchanged now for more than 100 years.

This known breech block system makes it possible, on the one hand, to carry out, successively at right-angles to each other, two movements of a breech bolt handle connected to parts of the breech block cylinder, so as to unlock the breech block cylinder and at the same time tension a tension spring for the purpose of accelerating a firing pin as well as withdrawing and ejecting a used cartridge case, and, on the other hand, to carry out the corresponding backward movements of the breech bolt handle for the purpose of inserting a new cartridge from a magazine into the chamber of the barrel and subsequently locking the breech block cylinder.

Furthermore, straight-pull bolt action systems are known in the prior art, in which the respective functions of the two right-angled movements of the Mauser 98 breech block system are combined to provide a linear movement of a breech bolt handle.

Both the straight-pull bolt action systems and the Mauser 98 breech block system are known to provide mirror-inverted implementations for right-handed persons and left-handed persons, the breech bolt handle for systems for right-handed persons being disposed on the right-hand side of a weapon and that for systems for left-handed persons on the left side of a weapon.

DE 100 55 578 A1 discloses a locking mechanism for a shotgun having accommodation means, a bolt that is axially displaceable in said accommodation means, a bolt grip for the bolt, means for arresting the bolt in a position in which it closes the lock of the weapon, extracting and ejecting devices in the locking mechanism and a firing pin in the bolt, in which the accommodation means and/or the bolt and/or the bolt grip have cam faces for primary extraction by swinging the bolt either clockwise or counter-clockwise, the accommodation means possessing openings in the weapon for the ejection of empty cartridge cases both to the left and to the right and the handle being mounted such that it is adjustable with reference to the bolt for optional operation by a left-handed person or a right-handed person to afford operability for both left-handed persons and right-handed persons.

DE 94 19 743 U1 discloses a repeater breech block having a chamber that is rotatable about its longitudinal axis and is axially displaceable in the direction of travel and the rear end face of which has a cam surface that is surrounded by a tension member of a breech bolt handle, having a firing pin that is axially displaceable in the region of the frame of the chamber, which is concentrically surrounded by a firing pin spring and has a small lock that is coupled at its rear end to the chamber, the breech bolt handle being optionally held in the chamber in a first position or in a second position set at approximately 180 degrees relatively thereto by means of a releasable pin-and-socket connector, in order to provide a breech block device that is suitable for use by both right-handed and left-handed persons.

Further breech block systems are disclosed in US 2010/0175290 A1 and U.S. Pat. No. 8,302,340 B1.

SUMMARY

The prior breech block systems suffer from the drawback that a system designated for a right-handed person is not capable of being rapidly and correctly retrofitted for a left-handed person.

It is an object of the invention to provide a breech block system or a breech block device for repeating firearm, particularly for a long gun, in which a bidirectional change from a right-handed system to a left-handed system can be quickly achieved with the aid of only a few adjustments.

In the case of a breech block device of the aforementioned type this object is achieved by the invention in that cocking of the firing pin (140) is effected by causing rotation, through a predefined angle, of a breech bolt handle rigidly connected to a tension crown ring (400) that is pivoted on a central shaft (210) of the breech block cylinder (200) wherein a plurality of equidistantly disposed tension cam crowns are provided on the tension crown ring and at least one clamping sleeve cam that is formed on a clamping sleeve that is mounted on a central shaft for linear displacement along the longitudinal axis thereof is adapted to cooperate, when said tension crown ring is rotated, with at least one tension cam crown attached to the tension crown ring, in order to move the clamping sleeve coupled with the firing pin to a position away from the magazine, and, in the course of movement of the firing pin, to a position at a predefined distance from the tension crown ring, the tension cam crowns being disposed on the tension crown ring and adapted for folding-symmetrical movement about at least two differently oriented symmetry axes, such that the combination of tension cam crowns and clamping sleeve cams produces a laterally symmetrical or folding-symmetrical structure of a left-right alternating system.

Preferred embodiments of the invention form the subject-matter of the sub-claims. The breech block device of the invention provides the structurally enabled possibility of creating an arrangement of a laterally symmetrical or folding-symmetrical system of the tension cam crowns and optionally also of the clamping sleeve cams as a result of the combination of features stated in the characterizing clause of the independent patent claim. This alone provides the conditions for engineering a laterally symmetrical or folding-symmetrical construction of the entire breech block device as is a fundamental prerequisite for achieving a left-right alternating system.

Using the breech block device of the invention, there is provided the possibility of having the tension cam crowns disposed on the tension crown ring so as to be folding-symmetrical about at least two of the differently oriented symmetry axes.

Alternately or additionally, provision can be made for the tension cam crowns to be disposed on the tension crown ring rotationally symmetrically with regard to rotation through at least one whole number multiple (i.e., two, three, or more multiples) of an angle of 30 degrees.

According to another preferred embodiment of the breech block device of the invention, provision is made for the clamping sleeve to have a plurality of clamping sleeve cams, the number of said clamping sleeve cams being the same as the number of tension cam crowns formed on the tension crown ring.

The clamping sleeve cams of the clamping sleeve are in each case preferably disposed folding-symmetrically about at least two of the differently oriented symmetry axes.

Here again, it is alternatively or additionally possible for the clamping sleeve cams of the clamping sleeve to be in each case disposed so as to be rotationally symmetrical with regard to a rotation through at least one integral multiple of on angle of 30 degrees.

The tension cam crowns are preferably formed in the region of that end face of the tension crown ring that is near to the clamping sleeve, and the clamping sleeve cams are preferably formed in the region of that end face of the clamping sleeve that is near the tension crown ring.

According to a further preferred embodiment of the breech block device of the invention provision is made for cooperation of a clamping sleeve cam with a tension cam crown to be enabled in that the clamping sleeve cam slides along a motion link formed on the tension cam crown, in order to move the clamping sleeve a predetermined distance away from the tension crown ring in order to achieve a tensioned state of the tension spring.

In order to prevent rotation of the clamping sleeve during a sliding movement of a clamping sleeve cam along the motion link formed on the tension cam crowns a and thus to ensure linear displacement of the clamping sleeve along the longitudinal axis of the central shaft, at least one cylindrical pin is provided, one end of which is attached to the clamping sleeve while the other end of which is guided in an oblong hole provided in the shaft.

According to an important preferred embodiment of the breech block device of the invention there are provided three equidistantly disposed tension cam crowns and three equidistantly disposed clamping sleeve cams.

According to another important preferred embodiment of the breech block device of the invention, the motion link is, at the center of a tension cam crown, at a maximum distance from that end face of the tension crown that is remote from the clamping sleeve and is, in the region between two adjacent tension cam crowns, at a minimum distance from that end face of the tension crown that is remote from the clamping sleeve, the motion link extending over an angular range of 120 degrees from a first point of minimum distance to an adjacent second point of minimum distance for each of the three tension cam crowns, with the formation of a unilateral flank of 60 degrees.

The difference between a maximum distance of the motion link from that end face of the tension crown that is remote from the clamping sleeve and a minimum distance of the motion link from that end face of the tension crown that is remote from the clamping sleeve is the same as that distance of the clamping sleeve from the tension crown ring as is required for tensioning the tension spring.

Furthermore, there are formed, in the region of the periphery of the tension crown ring, preferably three equidistantly disposed locking lugs for locking the breech block cylinders to the system housing of the repeater. Preferably, that end of the straight breech bolt handle that is remote from the bolt handle ball is attached to one of the locking lugs.

According to a further preferred embodiment of the breech block device of the invention provision is made for a recess for accommodating the breech bolt handle to be formed both on the right-hand side and on the left-hand side of the system housing of the repeating firearm.

BRIEF DESCRIPTION OF THE DRAWINGS

The breech block device of the invention is explained below with reference to a preferred embodiment illustrated in the figures of the drawings, in which.

DETAILED DESCRIPTION

Figure 1:
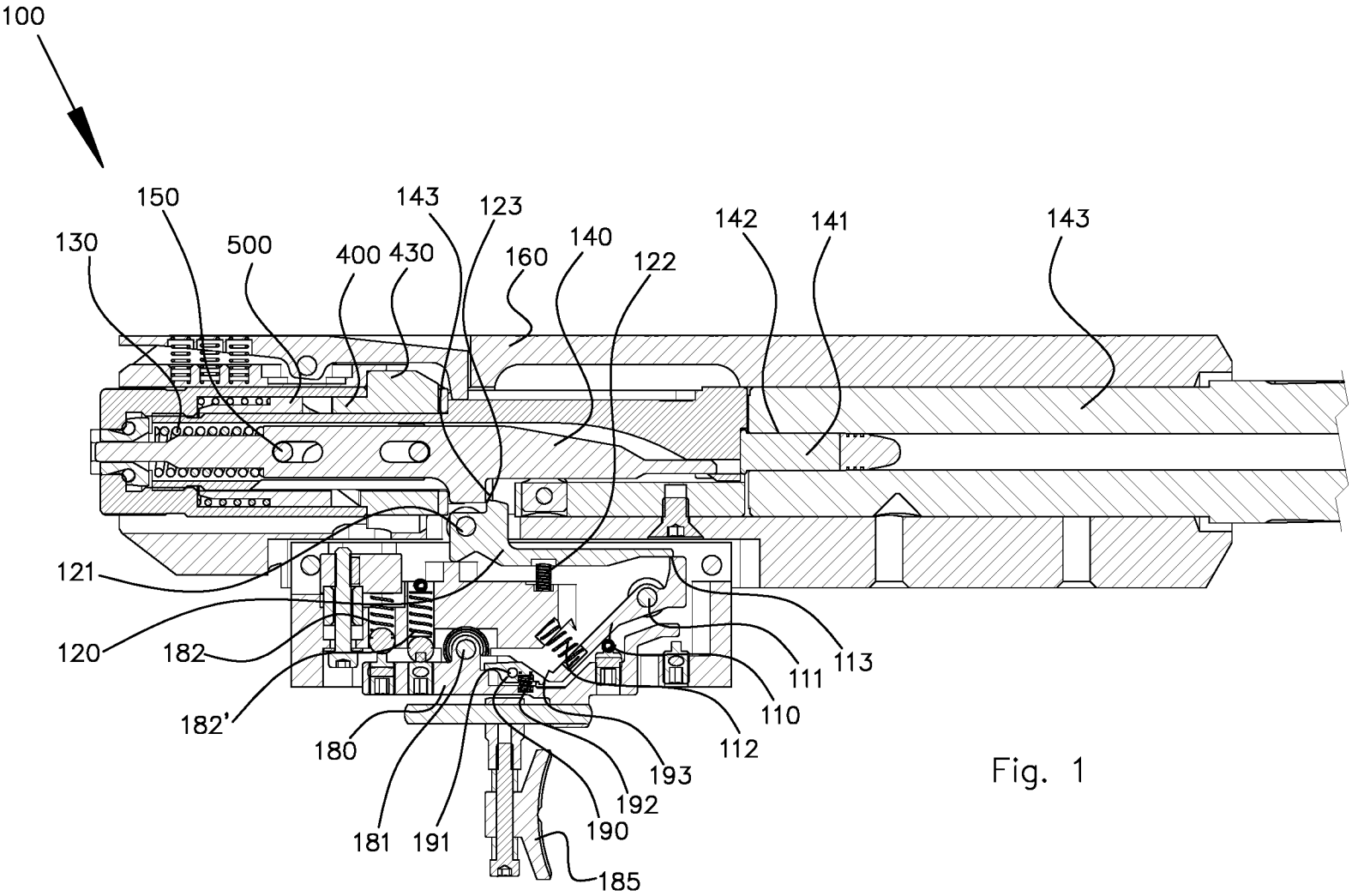
FIG. 1 shows a cross-sectional view of a first preferred embodiment of the breech block device of the invention mounted in a magazine of a barrel showing a first state of the firing pin in a side view.

The repeater cylinder breech block device 100 of the invention as shown in FIGS. 1 to 5 contains a breech block cylinder 200 having locking means and pivoted within a breech block sleeve of the repeating firearm for affording repetitive operation.

In the breech block cylinder 200 there is mounted a firing pin 140 adapted to be precocked by means of a tension spring 130 and mounted for linear displacement in the direction of a cartridge stored in a magazine of a barrel, cocking of the firing pin 140 being effected by rotation, through a predefined angle, of a breech bolt handle 300 rigidly connected to a tension crown ring 400 rotatably mounted around a central shaft 210 of the breech block cylinder 200.

With rotation of the tension crown ring 400, a clamping sleeve cam 510 formed on a clamping sleeve 500, which is linearly displaceable along the longitudinal axis of the central shaft 210, cooperates with a plurality of tension cam crowns 410 equidistantly disposed on the tension crown ring 400, in order to move the clamping sleeve coupled to the firing pin 140 to a position at a predetermined distance from the tension crown ring by causing the firing pin to move away from the chamber for the purpose of tensioning the tension spring.

In order to prevent any rotation of the clamping sleeve 500 due to a tension cam crown 410 touching a clamping sleeve cam 510 and thus to ensure linear displacement of the clamping sleeve 500 along the longitudinal axis of the central shaft 210, at least one cylindrical pin 150 is provided, one end of which is attached to the clamping sleeve 500 and the other end of which is guided in an oblong hole 211 formed in the shaft 210.

The tension cam crowns 410 are formed in the region of that end face 420 of the tension crown ring 400 that is disposed near the clamping sleeve 500, and the clamping sleeve cams 510 are formed in the region of that end face 520 of the clamping sleeve 500 that is disposed near the tension crown ring 400. By this means there are provided three equidistantly disposed tension cam crowns 410 and three equidistantly disposed clamping sleeve cams 510.

The tension cam crowns 410 are folding-symmetrically formed on the tension crown ring 400 surrounding at least two differently oriented symmetry axes and are thus rotationally symmetrically disposed with regard to rotation about an whole number multiple of 30 degrees, in the present case 120 degrees.

A plurality of clamping sleeve cams 510 are provided on the clamping sleeve 500, the number of clamping sleeve cams 510 being the same as the number of tension cam crowns 410 formed on the tension crown ring 400.

The clamping sleeve cams 510 of the clamping sleeve 500 are likewise in each case folding-symmetrically disposed about at least two differently oriented symmetry axes and are likewise disposed axially symmetrically with regard to rotation about an whole number multiple of 30 degrees, in the present case again 120 degrees.

In order to achieve cooperation of a clamping sleeve cam 510 with a tension cam crown 410, the clamping sleeve cam 510 slides along a motion link 415 formed on the tension cam crown 410, in order to move the clamping sleeve 500 to a predetermined distance away from the tension crown ring 400 for the purpose of achieving a tensioned state of the tension spring 130.

The motion link 415 is, at the center of a tension cam crown 410, at a maximum distance from that end face 416 of the tension crown 400 that is remote from the clamping sleeve 500 and is, between two adjacent tension cam crowns 410, at a minimum distance from the end face 416 of the tension crown 400 that is remote from the clamping sleeve 500, while the motion link 415 extends over an angular range of 120 degrees from a first point of minimum distance to an adjacent second point of minimum distance for each of the three tension cam crowns 410, with formation of a unilateral flank of 60 degrees.

The difference between a maximum distance of the motion link 415 from that end face 416 of the tension crown 400 that is remote from the clamping sleeve 500 and a minimum distance of the motion link 415 from that end face 416 of the tension crown 400 that is remote from the clamping sleeve 500 is the same as the distance of the clamping sleeve 500 from the tension crown ring 400 as specified for tensioning the tension spring 130.

In the region of the periphery of the tension crown ring 400 there are provided three equidistantly formed locking lugs 430 for locking the breech block cylinder to the system housing 160 of the repeater, that end 320 of the breech bolt handle 300 that is remote from a bolt handle ball 310 being attached to one of the locking lugs 430. The breech bolt handle 300 is of completely straight design.

A suitable recess 330 for the accommodation of the breech bolt handle 300 is formed both on the right side of the system housing 160 of the repeater and on the left side thereof.

Figure 2:
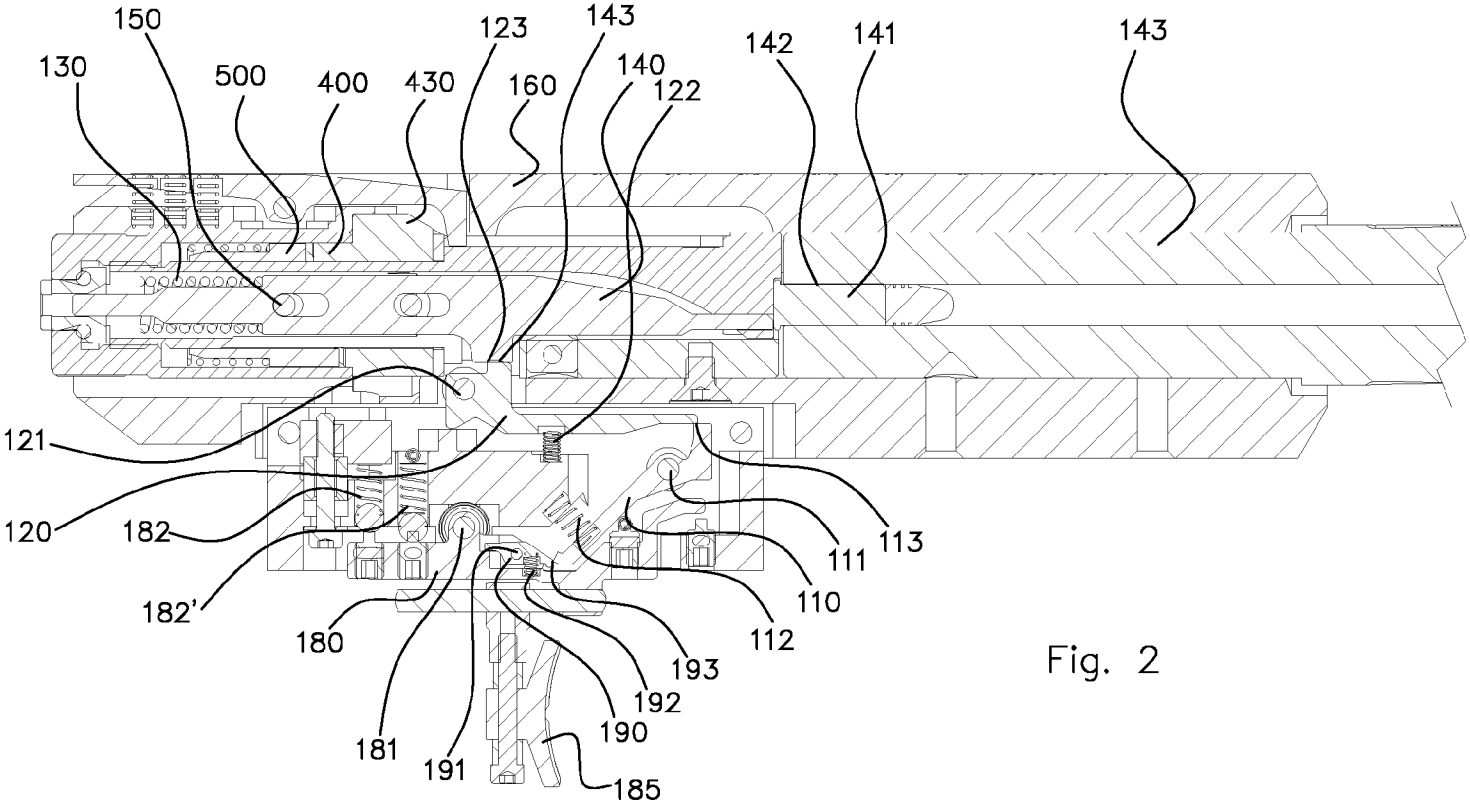
FIG. 2 shows a cross-sectional view of the preferred embodiment of the breech block device of the invention shown in FIG. 1 mounted in a magazine of a barrel showing a second state of the firing pin in a side view.
Figure 3:
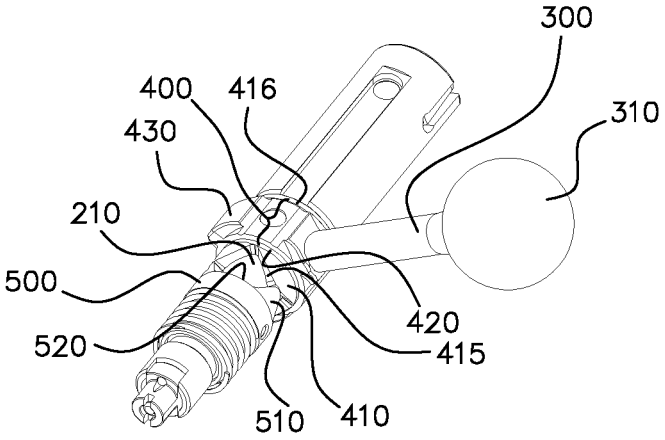
FIG. 3 shows an upwardly inclined view of the preferred embodiment of the breech block device of the invention shown in FIG. 1.
Figure 3A:
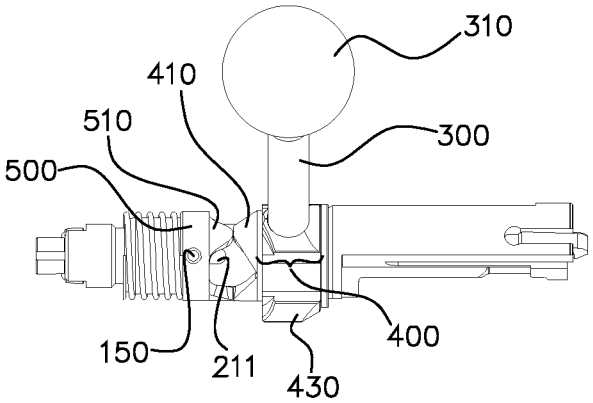
FIG. 3*a* shows a downwardly inclined view of the preferred embodiment of the breech block device of the invention shown in FIG. 1.
Figure 4:
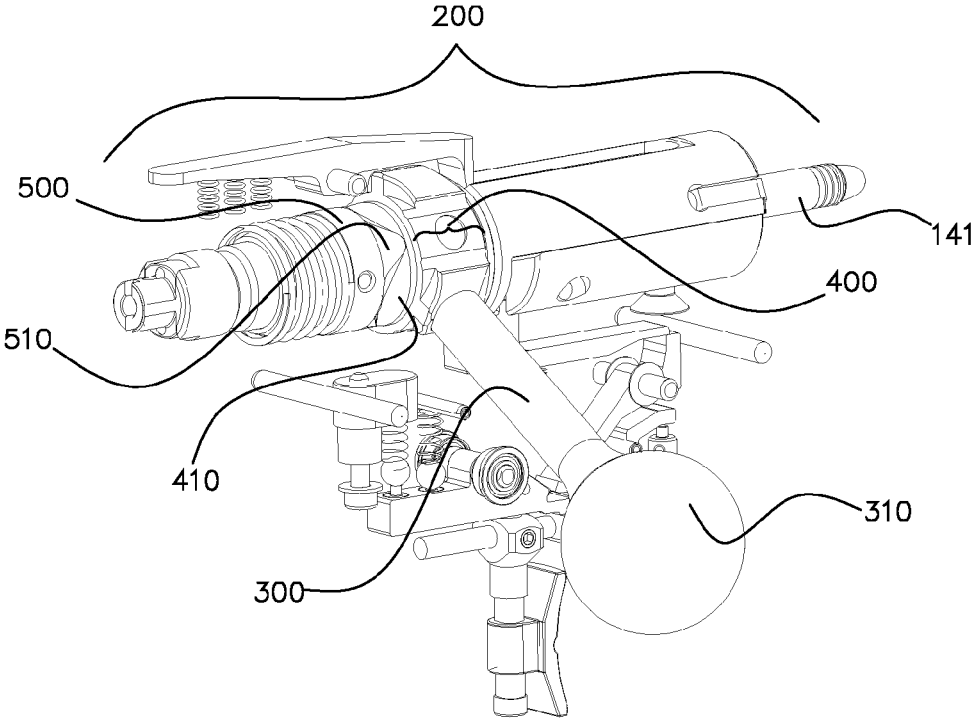
FIG. 4 shows a side view of the preferred embodiment of the breech block device of the invention shown in FIG. 1.
Figure 5:
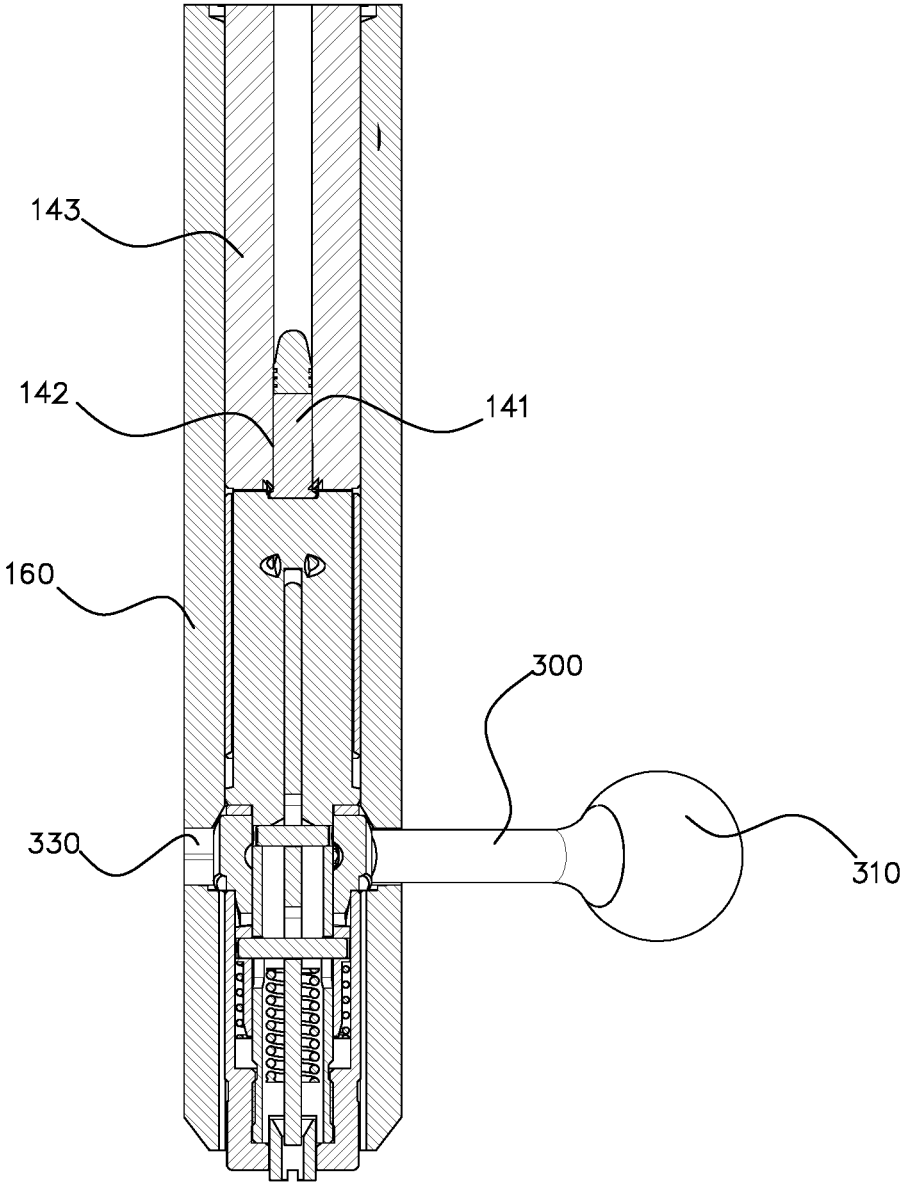
FIG. 5 shows a longitudinal cross-sectional view of the preferred embodiment of the breech block device of the invention shown in FIG. 1.

A movement of the firing pin 140 from a cocked position shown in FIG. 1 to an uncocked position shown in FIG. 2 in a side view whilst contacting a cartridge 141 stored in the magazine 142 of the barrel 143 of the repeater is initiated by movement of a trigger 185 pivoted about a shaft 181 and precocked contrary to the shooting direction by means of a coil spring 182, 182, by which means a tearoff edge 193 of a trigger pawl 190 pivoted on a shaft 191 and precocked by a tension spring 192 unblocks swiveling of an intermediate pawl 110 pivoted on a shaft 111 and precocked by means of a coil spring 112.

A tearoff edge 113 formed on the intermediate pawl 110 thus unblocks rotation of a trigger arm 120 pivoted on a shaft 121 and precocked by a coil spring 122, on which trigger arm 120 there is formed a tearoff edge 123, which snaps into a corresponding edge 143 of the firing pin 140 in the cocked position of the firing pin 140 and is released therefrom by means of a corresponding swivel of the trigger arm 120, by which means the firing pin 140, which has been precocked by the tension spring 130, is caused to move linearly in the direction of the cartridge 141 for the purpose of firing a round.

The exemplary embodiment of the invention described above merely serves the purpose of providing a better understanding of the teaching of the invention as defined in the claims, which teaching is not, as such, restricted to said exemplary embodiment.

What is claimed is:

1. A cylinder breech block device (100) of a repeating firearm having a breech block cylinder (200) pivoted in a system housing (160) of the repeating firearm for execution of repetitive action thereof and capable of being locked to said system housing (160) for firing a round, in which a firing pin (140) capable of being cocked by a tension spring is mounted for linear displacement in the direction of a cartridge (141) stored in a magazine (141) of a barrel (143), characterized in that:

cocking of the firing pin (140) is effected by causing rotation, through a predefined angle, of a breech bolt handle (300) rigidly connected to a tension crown ring (400) that is pivoted on a central shaft (210) of the breech block cylinder (200);

a plurality of equidistantly disposed tension cam crowns (410) are on said tension crown ring (400), circumferentially equidistantly disposed about the tension crown ring; and at least one clamping sleeve cam (510) is formed on a clamping sleeve (500) mounted on a central shaft (210) for linear displacement along the longitudinal axis thereof and being adapted, when said tension crown ring (400) is rotated, to cooperate with at least one tension cam crown (410) attached to said tension crown ring (400) in order to move the clamping sleeve (500) coupled to said firing pin (140) to a position away from said magazine, and during the course of movement of said firing pin (140), to a position at a specified distance from said tension crown ring (400), said tension cam crowns being disposed on the tension crown ring (400) and adapted for folding-symmetrical movement about at least two differently oriented symmetry axes, the combination of tension cam crowns and clamping sleeve cams being such as to produce a laterally symmetrical or folding-symmetrical structure of a left-right alternating system.

2. A breech block device (100) as claimed in claim 1, characterized in that:

said tension cam crowns (410) on said tension crown ring (400) are disposed axially symmetrically with regard to rotation through at least one whole number multiple of 30 degrees.

3. A breech block device (100) as claimed in claim 1, characterized in that:

said tension cam crowns (410) on said tension crown ring (400) are disposed folding-symmetrically about at least two of the differently oriented symmetry axes and are accordingly disposed axially symmetrically with regard to rotation about at least one whole number multiple of 30 degrees.

4. A breech block device (100) as claimed in claim 1, characterized in that:

on said clamping sleeve (500) there are disposed a plurality of clamping sleeve cams (510) in which the number of clamping sleeve cams (510) is the same as the number of tension cam crowns (410) formed on said tension crown ring (400).

5. A breech block device (100) as claimed in claim 4, characterized in that:

said clamping sleeve cams (510) of said clamping sleeve (500) are in each case folding-symmetrically disposed about at least two of the differently oriented symmetry axes.

6. A breech block device (100) as claimed in claim 4, characterized in that:

said clamping sleeve cams (510) of said clamping sleeve (500) are in each case disposed axially symmetrically with regard to rotation about at least one whole number multiple of 30 degrees.

7. A breech block device (100) as claimed in claim 4, characterized in that:

said clamping sleeve cams (510) of said clamping sleeve (500) are in each case disposed folding-symmetrically about at least two of the differently oriented symmetry axes and accordingly axially symmetrically with regard to rotation through at least one whole number multiple of 30 degrees.

8. A breech block device (100) as claimed in claim 1, characterized in that:

said tension cam crowns (410) are formed in that region of said end face (420) of said tension crown ring (410) that is near said clamping sleeve (500).

9. A breech block device (100) as claimed in claim 1, characterized in that:

said clamping sleeve cams (510) are formed in the region of that end face (520) of said clamping sleeve (500) that is near said tension crown ring (410).

10. A breech block device (100) as claimed in claim 1, characterized in that:

for achieving cooperation of a clamping sleeve cam (510) with a tension cam crown (410), said clamping sleeve cam (510) slides along a motion link (415) formed on said tension cam crown (410), in order to move said clamping sleeve (500) to a prescribed distance in a direction away from said tension crown ring (400) to achieve a tensioned state of said tension spring 130.

11. A breech block device (100) as claimed in claim 1, characterized in that:

there are provided three equidistantly disposed tension cam crowns (410) and three equidistantly disposed clamping sleeve cams (510).

12. A breech block device (100) as claimed in claim 11, characterized in that:

said motion link (415) is, at the center of a tension cam crown (410), at a maximum distance from that end face (416) of said tension crown (400) that is remote from said clamping sleeve (500) and is, in the region between two adjacent tension cam crowns, at a minimum distance from that end face (416) of said tension crown that is remote from said clamping sleeve (500), said motion link (415) extending over an angular range of 120 degrees from a first point of minimum distance to an adjacent second point of minimum distance with the formation of a unilateral flank of 60 degrees for each of said three tension cam crowns (410).

13. A breech block device (100) as claimed in claim 12, characterized in that:

the difference between a maximum distance of said motion link (415) from that end face (416) of said tension crown (400) that is remote from said clamping sleeve (500) and a minimum distance of said motion link (415) from that end face (416) of said tension crown (400) that is remote from said clamping sleeve (500) corresponds to a distance of said clamping sleeve (500) from said tension crown ring (400) as prescribed for tensioning said tension spring (130).

14. A breech block device (100) as claimed in claim 1, characterized in that:

the capability of linear displacement of said clamping sleeve (500) along the longitudinal axis of said central shaft (210) is made possible by means of at least one cylindrical pin (150), of which one end is secured in said clamping sleeve (500) and the other end of which is guided in an oblong hole (211) formed in said shaft (210).

15. A breech block device (100) as claimed in claim 1, characterized in that:

in the region of the periphery of said tension crown ring (400) there are formed three equidistantly disposed locking lugs (430) for locking said breech block cylinders (200) to said system housing (160) of the repeater.

16. A breech block device (100) as claimed in claim 15, characterized in that that:

an end (320) of said breech bolt handle (300) that is remote from a bolt handle ball (310) is attached to one of said locking lugs (430).

17. A breech block device (100) as claimed in claim 1, characterized in that:

the breech bolt handle (300) is of a straight design.

18. A breech block device (100) as claimed in claim 1, characterized in that:

a recess (330) is formed for the accommodation of said breech bolt handle (300) both on the right-hand side of said system housing (160) of the repeating firearm and on the left-hand side thereof.

19. A breech block device (100) as claimed in claim 1, characterized in that:

there are three to twelve said tension cam crowns (410).

20. A cylinder breech block device (100) of a repeating firearm having a breech block cylinder (200) pivoted in a system housing (160) of the repeating firearm for execution of repetitive action thereof and capable of being locked to said system housing (160) for firing a round, in which a firing pin (140) capable of being cocked by a tension spring is mounted for linear displacement in the direction of a cartridge (141) stored in a magazine (141) of a barrel (143), characterized in that:

cocking of the firing pin (140) is effected by causing rotation, through a predefined angle, of a breech bolt handle (300) rigidly connected to a tension crown ring (400) that is pivoted on a central shaft (210) of the breech block cylinder (200);

a plurality of equidistantly disposed tension cam crowns (410) are on said tension crown ring (400) and at least one clamping sleeve cam (510) that is formed on a clamping sleeve (500) mounted on a central shaft (210) for linear displacement along the longitudinal axis thereof being adapted, when said tension crown ring (400) is rotated, to cooperate with at least one tension cam crown (410) attached to said tension crown ring (400) in order to move the clamping sleeve (500) coupled to said firing pin (140) to a position away from said magazine, and during the course of movement of said firing pin (140), to a position at a specified distance from said tension crown ring (400), said tension cam crowns being disposed on the tension crown ring (400) and adapted for folding-symmetrical movement about at least two differently oriented symmetry axes, the combination of tension cam crowns and clamping sleeve cams being such as to produce a laterally symmetrical or folding-symmetrical structure of a left-right alternating system; and on said clamping sleeve (500) there are disposed a plurality of clamping sleeve cams (510) in which the number of clamping sleeve cams (510) is the same as the number of tension cam crowns (410) formed on said tension crown ring (400).

21. A breech block device (100) as claimed in claim 20, characterized in that:

said clamping sleeve cams (510) of said clamping sleeve (500) are in each case folding-symmetrically disposed about at least two of the differently oriented symmetry axes.

22. A breech block device (100) as claimed in claim 20, characterized in that:

said clamping sleeve cams (510) of said clamping sleeve (500) are in each case disposed axially symmetrically with regard to rotation about at least one whole number multiple of 30 degrees.

23. A breech block device (100) as claimed in claim 20, characterized in that:

said clamping sleeve cams (510) of said clamping sleeve (500) are in each case disposed folding-symmetrically about at least two of the differently oriented symmetry axes and accordingly axially symmetrically with regard to rotation through at least one whole number multiple of 30 degrees.

24. A cylinder breech block device (100) of a repeating firearm having a breech block cylinder (200) pivoted in a system housing (160) of the repeating firearm for execution of repetitive action thereof and capable of being locked to said system housing (160) for firing a round, in which a firing pin (140) capable of being cocked by a tension spring is mounted for linear displacement in the direction of a cartridge (141) stored in a magazine (141) of a barrel (143), characterized in that:

cocking of the firing pin (140) is effected by causing rotation, through a predefined angle, of a breech bolt handle (300) rigidly connected to a tension crown ring (400) that is pivoted on a central shaft (210) of the breech block cylinder (200);

a plurality of equidistantly disposed tension cam crowns (410) are on said tension crown ring (400) and at least one clamping sleeve cam (510) that is formed on a clamping sleeve (500) mounted on a central shaft (210) for linear displacement along the longitudinal axis thereof being adapted, when said tension crown ring (400) is rotated, to cooperate with at least one tension cam crown (410) attached to said tension crown ring (400) in order to move the clamping sleeve (500) coupled to said firing pin (140) to a position away from said magazine, and during the course of movement of said firing pin (140), to a position at a specified distance from said tension crown ring (400), said tension cam crowns being disposed on the tension crown ring (400) and adapted for folding-symmetrical movement about at least two differently oriented symmetry axes, the combination of tension cam crowns and clamping sleeve cams being such as to produce a laterally symmetrical or folding-symmetrical structure of a left-right alternating system; and the capability of linear displacement of said clamping sleeve (500) along the longitudinal axis of said central shaft (210) is made possible by means of at least one cylindrical pin (150), of which one end is secured in said clamping sleeve (500) and the other end of which is guided in an oblong hole (211) formed in said shaft (210).

* * * * *